US009853398B2

(12) United States Patent
Tsai et al.

(10) Patent No.: US 9,853,398 B2
(45) Date of Patent: Dec. 26, 2017

(54) PLUG CONNECTOR AND ELECTRONIC ASSEMBLY

(71) Applicant: HTC Corporation, Taoyuan (TW)

(72) Inventors: I-Leh Tsai, Taoyuan (TW); Chih-Cheng Huang, Taoyuan (TW); Chi-Kuang Lu, Taoyuan (TW); Chun-Lung Huang, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 14/855,370

(22) Filed: Sep. 15, 2015

(65) Prior Publication Data

US 2017/0077660 A1 Mar. 16, 2017

(51) Int. Cl.

| | |
|---|---|
| ***H01R 13/6581*** | (2011.01) |
| ***H01R 13/64*** | (2006.01) |
| ***H01R 24/60*** | (2011.01) |
| ***H01R 24/62*** | (2011.01) |
| ***H01R 4/26*** | (2006.01) |
| ***H01R 107/00*** | (2006.01) |

(52) U.S. Cl.

CPC ..... *H01R 13/6581* (2013.01); *H01R 24/60* (2013.01); *H01R 24/62* (2013.01); *H01R 4/26* (2013.01); *H01R 13/64* (2013.01); *H01R 2107/00* (2013.01)

(58) Field of Classification Search

CPC .... H01R 24/60; H01R 13/6581; H01R 13/64; H01R 4/26

See application file for complete search history.

(56) References Cited

U.S. PATENT DOCUMENTS

| | | | | |
|---|---|---|---|---|
| 5,622,522 | A * | 4/1997 | Tan | H01R 12/7052 439/607.28 |
| 7,364,445 | B1 | 4/2008 | Ni | |
| 7,594,827 | B2 * | 9/2009 | Takamoto | A63F 13/02 439/353 |
| 7,625,243 | B2 * | 12/2009 | Chen | H01R 23/6873 439/541.5 |

(Continued)

FOREIGN PATENT DOCUMENTS

| | | |
|---|---|---|
| TW | 200726007 | 7/2007 |
| TW | M365561 | 9/2009 |
| TW | M374692 | 2/2010 |

OTHER PUBLICATIONS

"Office Action of Taiwan Counterpart Application", dated Jul. 7, 2016, p. 1-p. 7.

*Primary Examiner* — James Harvey
*Assistant Examiner* — Oscar Jimenez
(74) *Attorney, Agent, or Firm* — JCIPRNET

(57) ABSTRACT

A plug connector is adapted to be connected to a receptacle connector. The plug connector includes an insulation body, a plurality of terminals and a metal housing. The terminals are fixed in the insulation body. The metal housing wraps the insulation body and the terminals and has a mating end. The insulation body and the metal housing construct a slot, which is adapted to couple a tongue portion of the receptacle connector. These terminals extend to the slot. The insulation body extends outward to the mating end from internal of the metal housing to cover at least a part of the mating end. Moreover, an electronic assembly including an electronic apparatus and the plug connector is also provided.

8 Claims, 2 Drawing Sheets

(56) References Cited

U.S. PATENT DOCUMENTS

| | | | | |
|---|---|---|---|---|
| 7,837,506 | B1 * | 11/2010 | Chiang | H01R 13/506<br>439/607.27 |
| 2014/0094066 | A1 * | 4/2014 | Do | H01R 13/6485<br>439/660 |
| 2014/0099824 | A1 * | 4/2014 | Chou | H01R 9/032<br>439/620.15 |
| 2015/0162684 | A1 * | 6/2015 | Amini | H01R 12/73<br>439/660 |
| 2015/0340813 | A1 * | 11/2015 | Ng | H01R 13/646<br>439/607.28 |
| 2015/0340815 | A1 * | 11/2015 | Gao | H01R 13/6581<br>439/607.01 |
| 2015/0340825 | A1 * | 11/2015 | Ng | H01R 24/70<br>439/607.28 |

* cited by examiner

PLUG CONNECTOR AND ELECTRONIC ASSEMBLY

BACKGROUND OF THE INVENTION

Field of the Invention

The application relates to an electrical connector, and particularly relates to a plug connector and an electronic assembly using the same.

Description of Related Art

A universal serial bus (USB) is a standard connector interface, and based on a high convenience of plug and play thereof, the USB is widely applied to various electronic products, for example, computer hosts, notebooks, flash disks, external storage hard disk drives, etc. In order to cope with a thinning tendency of volumes of the electronic products, a specification of the current USB is evolved from a standard USB to a mini USB with a smaller volume, and even evolved to a micro USB with a volume smaller than that of the mini USB, so as to facilitate applying to the thinned electronic products.

Taking a plug connector of the micro USB as an example, the plug connector generally includes an insulation body, a plurality of terminals fixed in the insulation body and a metal housing wrapping the insulation body. However, during a process of coupling the plug connector to a receptacle connector, an edge of the metal housing of the plug connector is liable to scratch a decorative housing of an electronic apparatus, which is unexpected to a user or a maintenance personnel, and may particularly increase a maintenance cost for maintenance.

SUMMARY OF THE INVENTION

The application is directed to a plug connector, which is avoided to scratch a decorative housing of an electronic apparatus.

The application is directed to an electronic assembly, in which a plug connect is avoided to scratch a decorative housing of an electronic apparatus.

The application provides a plug connector, which is adapted to be connected to a receptacle connector. The plug connector includes an insulation body, a plurality of terminals and a metal housing. The terminals are fixed in the insulation body. The metal housing wraps the insulation body and the terminals and has a mating end. The insulation body and the metal housing construct a slot, which is adapted to couple a tongue portion of the receptacle connector. These terminals extend to the slot. The insulation body extends outward to the mating end from internal of the metal housing to cover at least a part of the mating end.

The application provides an electronic assembly including an electronic apparatus and the aforementioned plug connector.

According to the above description, in the application, the insulation body of the plug connector extends to cover the mating end of the metal housing, such that the mating end does not directly contact the decorative housing of the electronic apparatus, so as to avoid a situation that the mating end of the metal housing scratch the decorative housing of the electronic apparatus.

To make the above features and advantages of the application more comprehensible, several embodiments accompanied with drawings are described in detail as follows.

DESCRIPTION OF EMBODIMENTS

Figure 1:
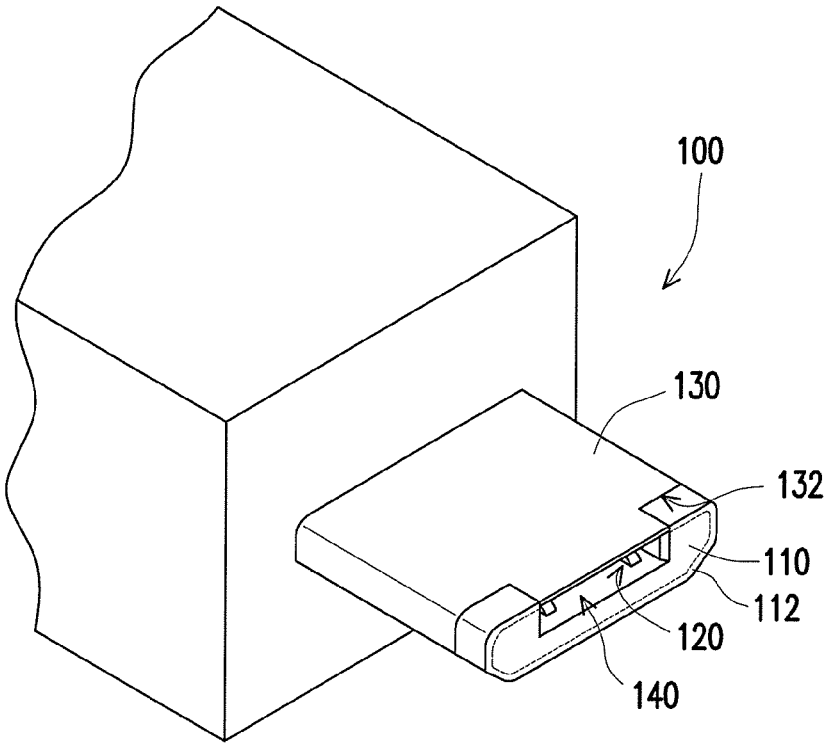
FIG. 1 is a top perspective view of a plug connector according to an embodiment of the application.
Figure 2:
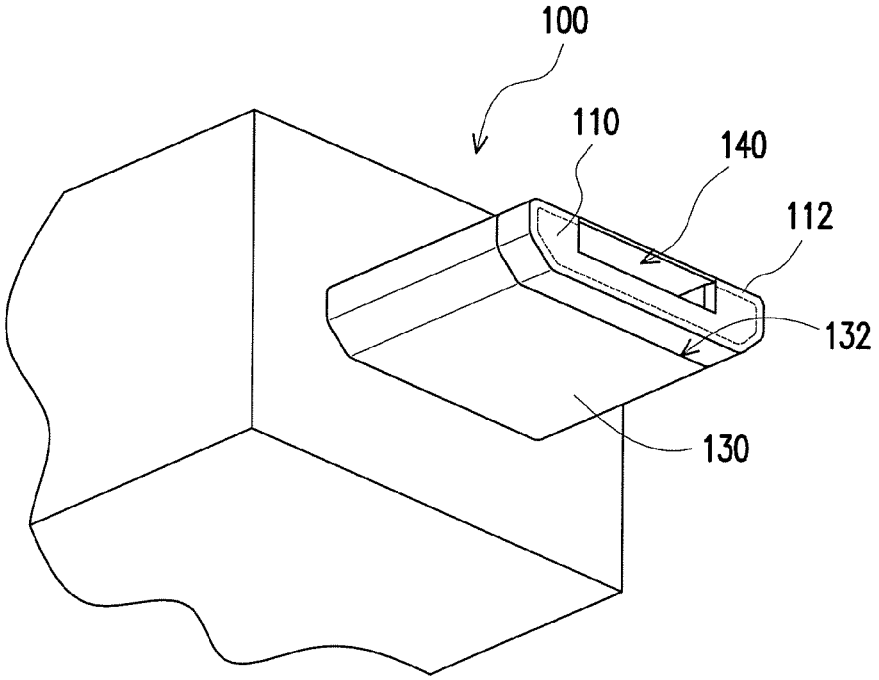
FIG. 2 is a bottom perspective view of the plug connector of FIG. 1.
Figure 3:
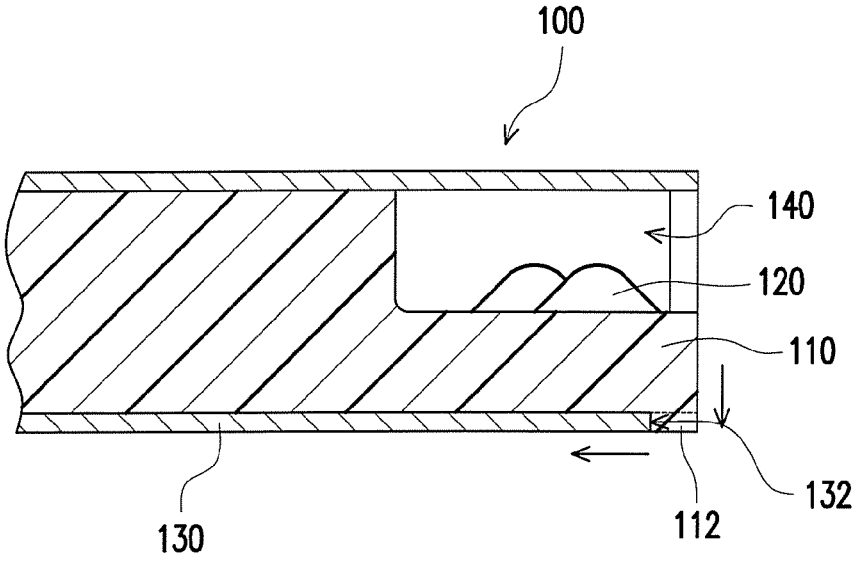
FIG. 3 is a partial cross-sectional view of the plug connector of FIG. 1.

Referring to FIG. 1, FIG. 2 and FIG. 3, a plug connector 100 is adapted to be coupled to a receptacle connector (for example, a plug connector 52 shown in FIG. 4) of a corresponding specification. A specification of the plug connector 100 can be a standard USB, a mini USB or a micro USB, and a type of each USB may include type A, type B or type C. However, in other embodiments, the application can also be applied to other plug connectors with a similar structure. In the following content, the plug connector of the micro USB is taken as an example for description.

The plug connector 100 includes an insulation body 110, a plurality of terminals 120 and a metal housing 130. The terminals 120 are fixed in the insulation body 110, and a used for contacting terminals of the receptacle connector of the corresponding specification. The metal housing 130 wraps the insulation body 110 and the terminals 120, and constructs a slot 140 together with the insulation body 110, where the slot 140 is adapted to couple a tongue portion of the receptacle connector (for example, a tongue portion 52*a* of a plug connector 52 of FIG. 4). The terminals 120 extend to the slot 140.

In the present embodiment, the insulation body 110 has a protection portion 112, and the metal housing 130 has a mating end. The protection portion 112 of the insulation body 110 extends outward to the mating end 132 from internal of the metal housing 130 to cover at least a part of the mating end 132.

Figure 4:
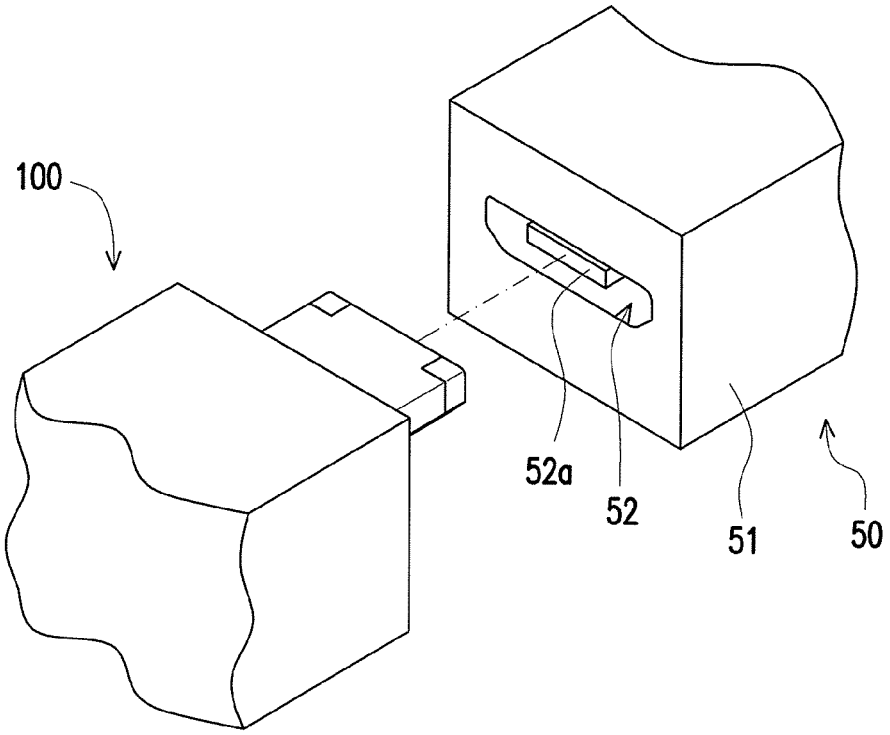
FIG. 4 is a perspective view of the plug connector of FIG. 1 to be inserted into a receptacle connector of an electronic apparatus.

Referring to FIG. 1 and FIG. 4, during a process that a user couples the plug connector 100 to the receptacle connector 52 disposed in the electronic apparatus 50 to form an electronic assembly, the protection portion 112 of the insulation body 110 extends to cover the mating end 132, and particularly cover a corner portion or a sharp portion of the mating end 132. To be specific, the metal housing 130 presents a hollow flat shape, and has a pair of side edges opposite to each other, where one end of each of the side edges of the metal housing 130 constructs a corner of the mating end 130.

In the present embodiment, the protection portion 112 is structurally formed by a part of the insulation body 110. In another embodiment, the protection portion 112 can be structurally independent to the insulation body 110. Therefore, the corner portion or the sharp portion of the mating end 132 of the metal housing 130 does not directly contact a decorative housing 51 of the electronic apparatus 50, but the protection portion 112 of the insulation body 110 extends to the mating end 132 to contact the decorative housing 51 of the electronic apparatus 50. Since a hardness of the protection portion 112 is smaller than a hardness of the metal housing 130, the mating end 132 of the metal housing 130 is avoided to scratch the decorative housing 51 of the electronic apparatus 50.

In the present embodiment, the mating end 132 of the metal housing 130 can be retreated by a short distance to form a little space, and the protection portion 112 of the insulation body 110 extends to the aforementioned little space such that the protection portion 112 extended to the mating end 132 is flush with the mating end 132 to comply with the corresponding specification.

In summary, in the application, the insulation body of the plug connector extends to cover the mating end of the metal housing, such that the mating end does not directly contact the decorative housing of the electronic apparatus, so as to avoid a situation that the mating end of the metal housing scratch the decorative housing of the electronic apparatus.

Although the application has been described with reference to the above embodiments, the application is not limited to the above embodiments. It is apparent to one of ordinary skill in the art that modifications and variations to the described embodiments may be made without departing from the spirit and scope of the application. Accordingly, the scope of the application will be defined by the attached claims.

What is claimed is:

1. A plug connector, adapted to be connected to a receptacle connector, the plug connector comprising:

an insulation body having a protection portion, wherein the protection portion is structurally formed by a part of the insulation body;

a plurality of terminals directly contacted and fixed in the insulation body; and a metal housing wrapping the insulation body and the terminals and having a mating end, wherein the insulation body and the metal housing construct a slot adapted to couple a tongue portion of the receptacle connector, the terminals extend to the slot, and the protection portion of the insulation body extends outward to the mating end from internal of the metal housing to cover at least a part of the mating end, wherein the plug connector has an end surface exposing the plurality of terminals, and at the end surface of the plug connector, the protection portion is flush with the metal housing.

2. The plug connector as claimed in claim 1, wherein a hardness of the protection portion is smaller than a hardness of the metal housing.

3. The plug connector as claimed in claim 1, wherein a part of the protection portion of the insulation body extended to the mating end covers a corner of the mating end.

4. The plug connector as claimed in claim 1, wherein the metal housing presents a hollow flat shape, and has a pair of side edges opposite to each other, and one end of each of the side edges of the metal housing constructs a corner of the mating end.

5. The plug connector as claimed in claim 1, wherein a part of the protection portion of the insulation body extended to the mating end is flush with the mating end.

6. The plug connector as claimed in claim 1, wherein a specification of the plug connector is a standard universal serial bus, a mini universal serial bus or a micro universal serial bus.

7. The plug connector as claimed in claim 6, wherein a type of each of the universal serial buses comprises type A, type B or type C.

8. An electronic assembly, comprising:

an electronic apparatus having a receptacle connector; and a plug connector coupled to the receptacle connector and comprising:

an insulation body having a protection portion, wherein the protection portion is structurally formed by a part of the insulation body;

a plurality of terminals directly contacted and fixed in the insulation body; and a metal housing wrapping the insulation body and the terminals and having a mating end, wherein the insulation body and the metal housing construct a slot adapted to couple a tongue portion of the receptacle connector, the terminals extend to the slot, and the protection portion of the insulation body extends outward to the mating end from internal of the metal housing to cover a part of the mating end, wherein the plug connector has an end surface exposing the plurality of terminals, and at the end surface of the plug connector, the protection portion is flush with the metal housing.

* * * * *